US006225914B1

(12) United States Patent
Weng

(10) Patent No.: US 6,225,914 B1
(45) Date of Patent: May 1, 2001

(54) AUTOMATIC VOICE DEVICE FOR FIRE EXTINGUISHER

(75) Inventor: Linsong Weng, Chu-Pei (TW)

(73) Assignee: Hugewin Electronics Co., Ltd., Chu-Pei (TW)

( * ) Notice: Subject to any disclaimer, the term of this patent is extended or adjusted under 35 U.S.C. 154(b) by 0 days.

(21) Appl. No.: 09/500,429

(22) Filed: Feb. 9, 2000

(51) Int. Cl.[7] ..... G08B 25/08

(52) U.S. Cl. ..... 340/692; 169/23; 200/61.49; 340/571; 340/689; 434/226

(58) Field of Search ..... 340/692, 384.7, 340/571, 566, 669, 690, 689; 200/61.45 R, 61.48, 61.49, 61.51, 61.52; 169/23; 434/226

(56) References Cited

U.S. PATENT DOCUMENTS 4,303,395 * 12/1981 Bower ..... 434/226
4,679,033 * 7/1987 Hwang ..... 340/566
4,942,386 * 7/1990 Willis ..... 340/566
5,460,228 * 10/1995 Butler ..... 340/692 X
5,775,430 * 7/1998 McSheffrey ..... 169/30

* cited by examiner

*Primary Examiner*—Thomas Mullen
(74) *Attorney, Agent, or Firm*—Rosenburg, Klein & Lee

(57) ABSTRACT

The present invention proposes a voice device for a fire extinguisher. The voice device is installed on a fire extinguisher. The voice device comprises a power source, a control switch, a spring rocking switch, a capacitor, a voice IC, and a sound device. The spring rocking switch is connected to the power source. The voice IC is driven to output a specific signal when the spring rocking switch is on and electricity is conducted. The voice amplifying circuit receives the signal from the voice IC and outputs an amplified signal to the sound device for giving specific voices recorded in the voice IC. When the fire extinguisher is rocked, the voice device will automatically tell the user how to operate the fire extinguisher.

4 Claims, 4 Drawing Sheets

AUTOMATIC VOICE DEVICE FOR FIRE EXTINGUISHER

FIELD OF THE INVENTION

The present invention relates to an electronic voice device and, more particularly, to an automatic voice device for a fire extinguisher.

BACKGROUND OF THE INVENTION

Along with continual increase of safety consciousness in modern lives, safety requirement of inhabitant environment becomes higher and higher. However, there are still some hazards, such as fires, that can not be completely spared. If fires can be put out immediately when they happen, some misfortunes can be avoided.

Fire extinguishers are indispensable equipment to secure lives and properties of respective families. But the user usually does not know how to operate the fire extinguisher in emergency such that its fire extinguishing function can not be exploited. Moreover, fog usually pervades the fire site such that there is not enough light for the operation guide on the fire extinguisher to be seen clearly. Good chance to put out the fire is thus lost such that the fire can not be put out betimes.

SUMMARY AND OBJECTS OF THE PRESENT INVENTION

The primary object of the present invention is to provide an automatic voice device for a fire extinguisher such that even if there is not enough light in the fire site or fog pervades the fire site, the present invention can also be used to provide verbal explanation of the operation procedures of the fire extinguisher.

Another object of the present invention is to provide an automatic voice device for a fire extinguisher, which will automatically tell the operation procedures of the fire extinguisher when rocked.

According to the present invention, operation procedures of the fire extinguisher are recorded in a voice integrated circuit (IC). The voice IC is connected to a spring rocking switch and the assembly is placed in a metallic case or a plastic case to form a voice device. The voice device is then installed on the fire extinguisher. When the fire extinguisher is rocked, the voice device will automatically tell the user how to operate the fire extinguisher.

The various objects and advantages of the present invention will be more readily understood from the following detailed description when read in conjunction with the appended drawings, in which:

DETAILED DESCRIPTION OF PREFERRED EMBODIMENT

Figure 1:
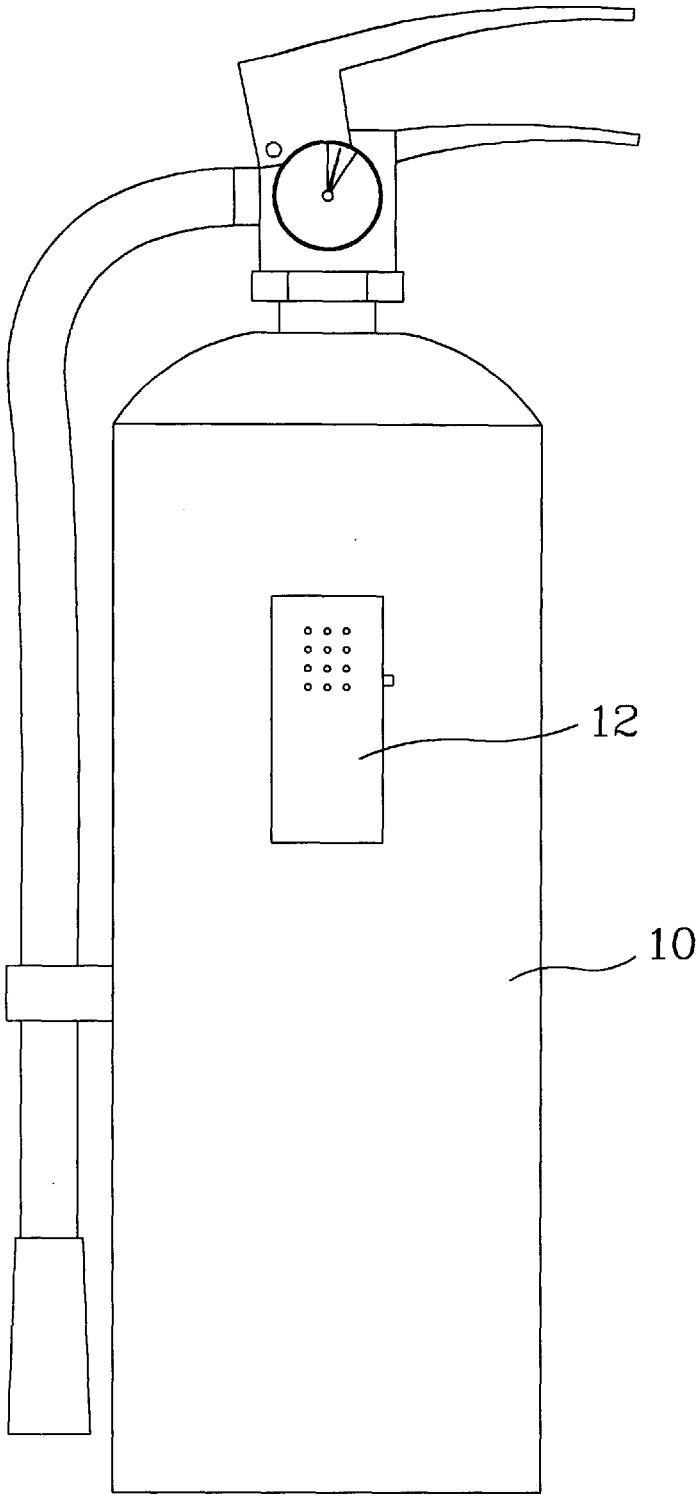
FIG. 1 is a perspective view of the present invention.

As shown in FIG. 1, a voice device 12 in installed on a fire extinguisher 10 by means of sticking. Different verbal explanations are recorded in different voice devices installed on different fire extinguishers. The voice device 12 can also be directly formed on the fire extinguisher 10.

Figure 2:
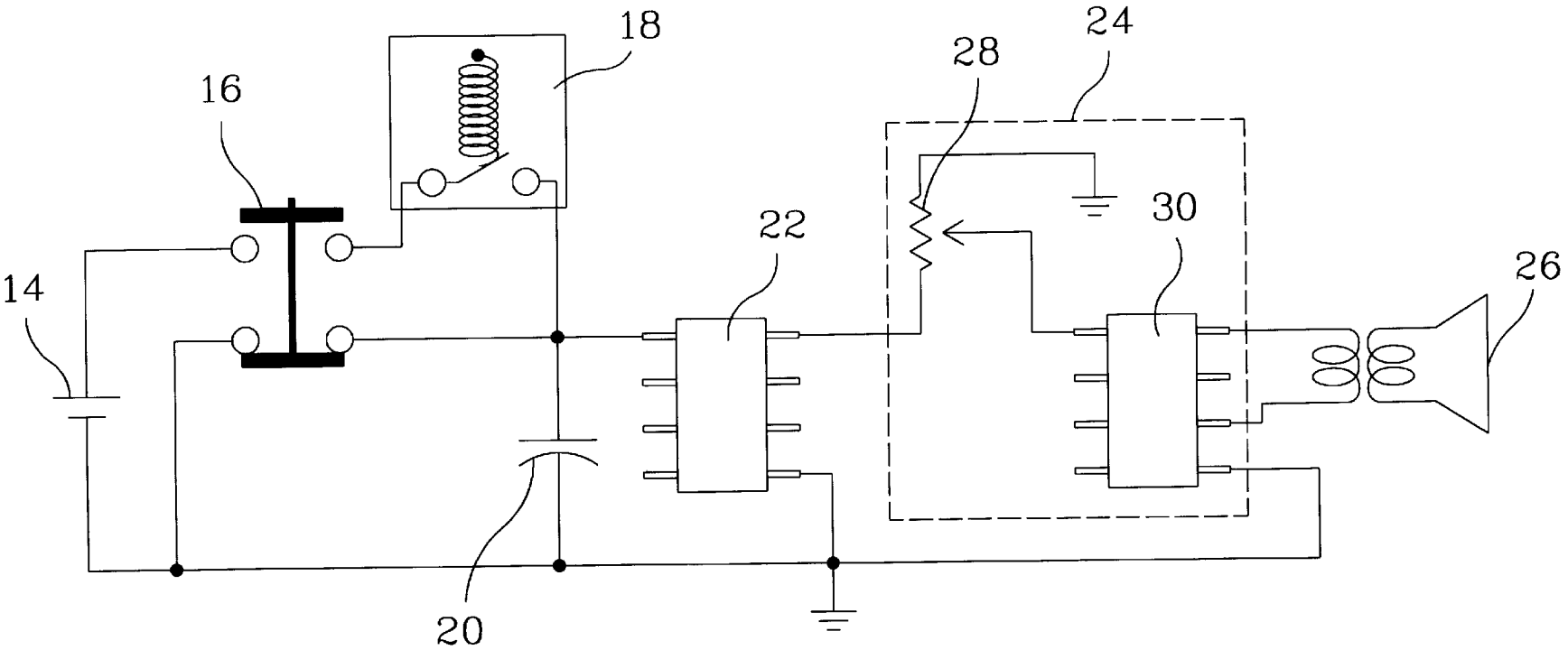
FIG. 2 is a diagram showing the circuit structure of the present invention.

As shown in FIG. 2, a power source being a battery 14 is connected to a control switch 16 for setting the on or off state of the power source. A spring rocking switch 18, which will be activated when rocked, is connected to a capacitor 20. When the spring rocking switch is on and current is conducted, the capacitor 20 will be charged. An electronic voice IC 22 is connected to the capacitor 20 and a gain-adjustable voice amplifying circuit 24. A sound device being a small speaker 26 is connected to the voice amplifying circuit 24. A voice device is thus assembled. The voice amplifying circuit 24 comprises a small variable resistor 28 and an output amplifying circuit 30. The variable resistor 28 is also connected to a volume control switch to control the volume of the output voice.

When the control switch 16 is on and the spring rocking switch 18 is rocked, current is conducted to charge the capacitor 20 for providing enough electricity to drive the electronic voice IC 22. A specific signal is output to the voice amplifying circuit 24 to be amplified and transferred to the small speaker 26 for giving specific voices recorded in the electronic voice IC 22 telling the operation procedures of the fire extinguisher.

Figure 3:
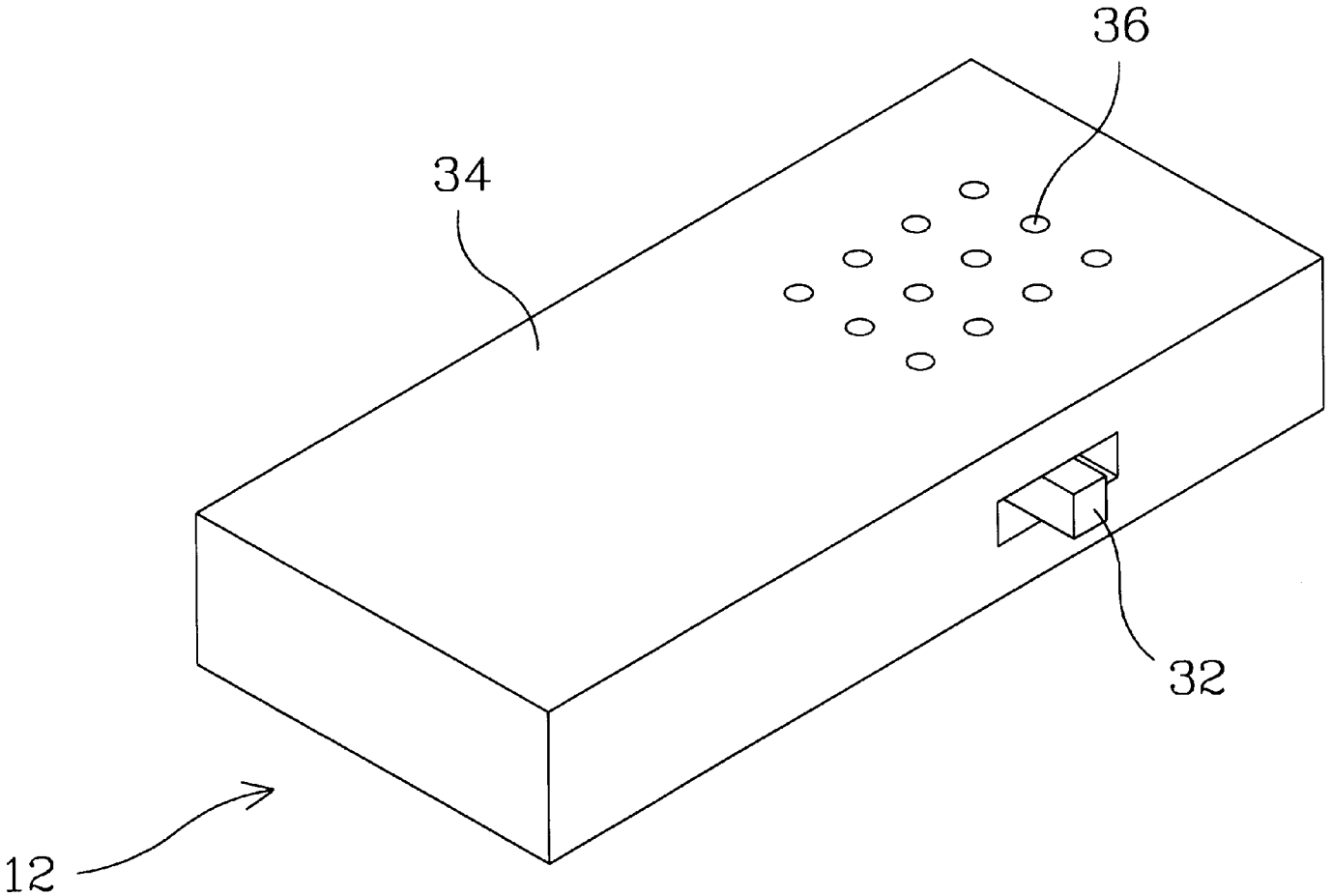
FIG. 3 is a diagram showing the voice device of the present invention.

As shown in FIG. 3, the voice device 12 is placed in a small case 34 being a metallic case or a plastic case. A plurality of through holes is disposed on the case such that voice from the small speaker can be clearly heard. The volume control switch 32 is installed on one side of the case to control the volume of the output voice.

Figure 4:
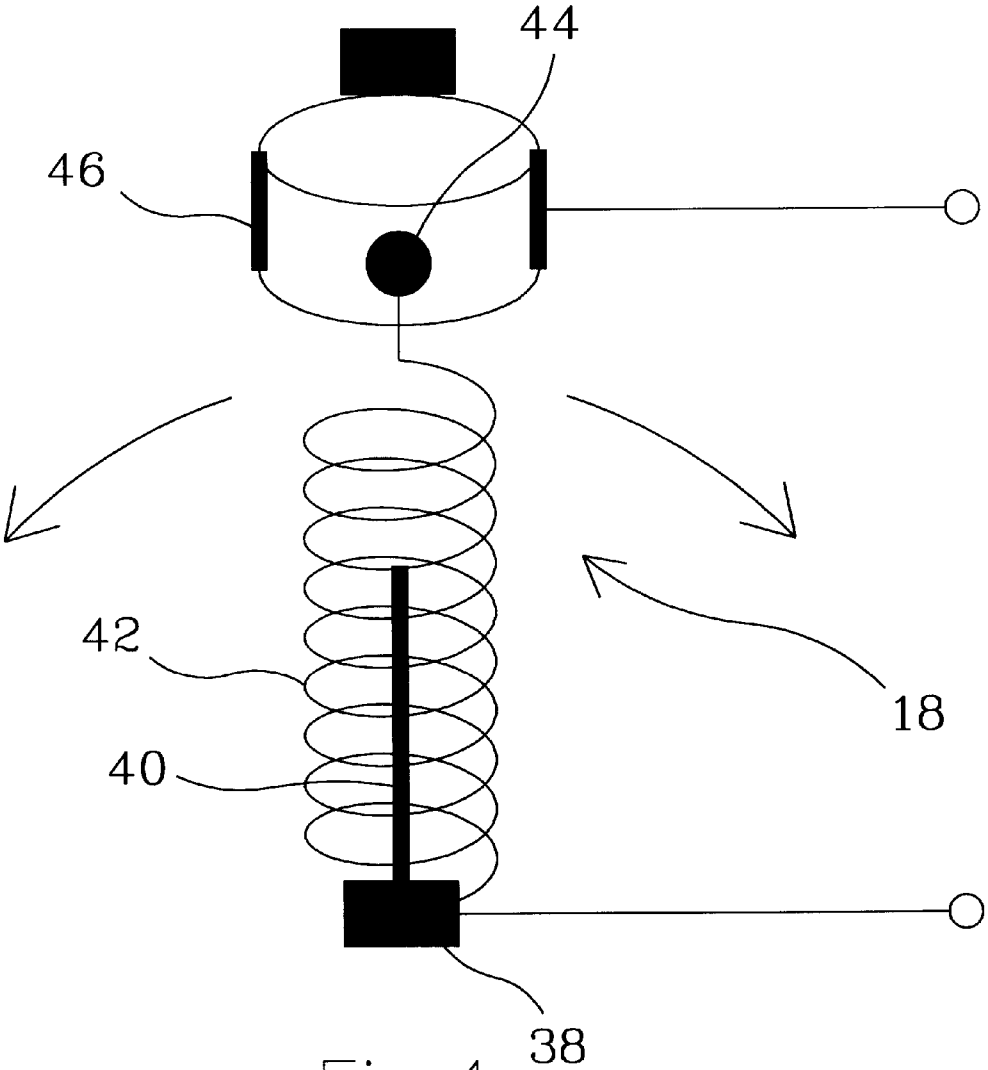
FIG. 4 is a diagram showing the spring rocking switch of the present invention.

The structure of the spring rocking switch 18 is shown in FIG. 4. A positioning bar 40 is installed at the center of a positioning seat 38. A spring 42 is connected to and surrounds the positioning seat 38. The positioning bar 40 is used to keep the spring 42 from deviation when rocked. A contact 44 is disposed at the top of the spring 42. A switch contact surface 46 is installed around the contact 44. When the spring rocking switch 18 is rocked, the spring 42 swings thereabouts such that the contact 44 at the top thereof contacts with the switch contact surface 46. Current is conducted immediately to charge the capacitor 20, which can then supply enough electricity for the voice device to give sound a few seconds. Therefore, if the fire extinguished is continually rocked, enough electricity can be provided for the voice device to tell the operation procedures of the fire extinguisher.

The spring rocking switch controls the on or off state of the voice device. However, there are some situations in which we do not want the voice device to give sound. A control switch is exploited such that when the fire extinguished is used up or is transported, the control switch is set to off to cut off the power. In regular situations, the control switch is set to on such that when the fire extinguisher is rocked in emergency, the voice device will give sound telling the operation procedures of the fire extinguisher.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A voice device for a fire extinguisher installed on a fire extinguisher, comprising:

a power source providing required electricity, a control switch connected to said power source, a spring rocking switch connected to said control switch, a capacitor connected to said spring rocking switch, a voice IC connected to said capacitor, said voice IC being driven to output a specific signal when electricity is conducted, a voice amplifying circuit receiving said signal from said voice IC and outputting an amplified signal, and a sound device connected to said voice amplifying circuit to receive said amplified signal.

2. The voice device for a fire extinguisher of claim 1, wherein said power source is a battery.

3. The voice device for a fire extinguisher of claim 1, wherein said voice amplifying circuit comprises a variable resistor and an output amplifying circuit, and said variable resistor is connected to a volume control switch to control the volume.

4. The voice device for a fire extinguisher of claim 1, wherein said sound device is a speaker.

* * * * *